US006634930B1

(12) United States Patent
Chen et al.

(10) Patent No.: US 6,634,930 B1
(45) Date of Patent: Oct. 21, 2003

(54) METHOD AND APPARATUS FOR PREVENTING METAL CORROSION DURING CHEMICAL MECHANICAL POLISHING

(75) Inventors: Ying-Ho Chen, Taipei (TW); Wen-Chih Chiou, Maioli (TW); Tsu Shih, Hsin-Chu (TW); Syun-Ming Jang, Hsin-Chu (TW); Chia-Ming Yang, Hsin-Chu (TW)

(73) Assignee: Taiwan Semiconductor Manufacturing Co. Ltd, Hsin Chu (TW)

( * ) Notice: Subject to any disclaimer, the term of this patent is extended or adjusted under 35 U.S.C. 154(b) by 132 days.

(21) Appl. No.: 09/635,013

(22) Filed: Aug. 9, 2000

(51) Int. Cl.[7] ..... B24B 1/00
(52) U.S. Cl. ..... 451/41; 451/54; 451/60
(58) Field of Search ..... 451/41, 54, 60

(56) References Cited

U.S. PATENT DOCUMENTS 5,888,124 A * 3/1999 Lin et al. ..... 134/184
6,206,760 B1 * 3/2001 Chang et al. ..... 451/41
6,213,853 B1 * 4/2001 Gonzalez-Martin et al. 451/287
6,217,410 B1 * 4/2001 Holzapfel et al. ..... 451/11
6,325,698 B1 * 12/2001 Wada et al. ..... 451/41
6,350,177 B1 * 2/2002 Gonzalez-Martin et al. 451/287
6,361,407 B1 * 3/2002 Lu et al. ..... 451/41
RE37,622 E * 4/2002 Karlsrud et al. ..... 451/11

* cited by examiner

*Primary Examiner*—M. Rachuba
(74) *Attorney, Agent, or Firm*—Tung & Associates

(57) ABSTRACT

A method for preventing copper corrosion on a wafer during a chemical mechanical polishing process when the process is temporarily halted due to equipment malfunction and an apparatus for carrying out such method are disclosed. In the method, after the chemical mechanical polishing process is stopped for correcting equipment malfunction or any other processing problems, a cleaning solvent is sprayed toward the wafer surface to remove substantially all slurry solution from the surface to prevent corrosion of the copper layer, or other metal layer, by the slurry solution. The cleaning solvent may be sprayed from spray nozzles mounted around and juxtaposed to the polishing table onto which the polishing pad is mounted as long as the spray nozzles do not interfere with the rotation of the polishing pad.

7 Claims, 2 Drawing Sheets

METHOD AND APPARATUS FOR PREVENTING METAL CORROSION DURING CHEMICAL MECHANICAL POLISHING

FIELD OF THE INVENTION

The present invention generally relates to a method and apparatus for chemical mechanical polishing and more particularly, relates to a method and apparatus for preventing metal corrosion on an electronic substrate during a chemical mechanical polishing process when the process is temporarily halted due to tool alarm by removing slurry solution from the substrate surface.

BACKGROUND OF THE INVENTION

Method and apparatus for polishing thin, flat semiconductor wafers are well-known in the art. Such apparatus normally includes a polishing head which carries a membrane for engaging and forcing a semiconductor wafer against a wetted polishing surface, such as a polishing pad. Either the pad, or the polishing head rotates and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a walfer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material.

An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. It is known in the art that uniformity in wafer polishing is a function of pressure, velocity and the concentration of chemicals. Edge exclusion is caused, in part, by non-uniform pressure on a wafer.

The mechanism for chemical mechanical polishing of metal is different and more complex than the polishing of silicon oxide. It is generally believed that during the CMP of metal, metal form an oxide layer on the surface which is subsequently removed by the polishing pad by a mechanism similar to that for oxide polishing. For instance, a mechanism that involves hydroxylation, bond formation with slurry and then, bond breaking from wafer. After the metal oxide layer is removed from the metal surface, metal is etched by the chemicals in the slurry solution, while simultaneously the exposed metal forms a new passivation layer through oxidation by the slurry solution. In practice, it is believed that three processes, i.e. the removal of metal oxide, the metal etching and the metal passivation occur simultaneously. A polishing slurry solution for use in metal CMP therefore contains three major components of fine slurry particles, a corrosion or etchant agent and an oxidant. The eventual planarization of the metal surface is achieved by the rigidity and planarity of the polishing pad similar to a process of oxide polishing.

When the metal being polished in the CMP process is copper, the polishing process becomes more complicated due to the characteristics of copper. Since copper is frequently used in multi-level interconnect structures in semiconductor devices, i.e. in damascene or dual damascene structures, a CMP step for forming copper interconnects in the damascene structures with satisfactory polishing uniformity becomes an important link in the entire fabrication process. The copper CMP process produces a fresh copper surface which is susceptible to corrosion when contacted by a variety of chemicals, including those contained in a slurry solution.

The corrosion of a metal layer on a wafer surface is more severe when the metal layer is formed of copper. Since in other metals such as tungsten and aluminum, a thin layer of metal oxide will be formed to stop further oxidation of fresh metal under the oxide layer. The formation of copper oxide does not stop the further oxidation of fresh copper under copper oxide. As a result, when the fresh copper surface is in contact with a CMP slurry solution for any significant length of time, i.e., more than three minutes, deep pitted areas of, copper oxide are formed. The depth of the copper oxide areas formed is so large such that any repair attempted on the wafer surface would not be effective to save the wafer from being scrapped. It therefore presents a serious problem in chemical mechanical polishing a copper layer on a wafer surface when the wafer surface may be subjected to a stationary contact with a slurry solution for any extended length of time, such as in a tool alarm situation wherein the polishing apparatus is shut down temporarily for correcting mechanical or other problems.

It is therefore an object of the present invention to provide a method for chemical mechanical polishing copper that does not have the drawbacks or shortcomings of the conventional copper CMP process.

It is another object of the present invention to provide a method for chemical mechanical polishing copper on a semiconductor device that does not have copper corrosion problem.

It is a further object of the present invention to provide a method for chemical mechanical polishing copper on a semiconductor device that does not have copper corrosion problem even when the process is temporarily halted due to a tool alarm situation.

It is another further object of the present invention to provide a method for prevent meal corrosion on a wafer during a chemical mechanical polish process by spraying a cleaning solvent toward the wafer surface removing slurry solution when the polishing process is stopped.

It is still another object of the present invention to provide a method for preventing copper corrosion on a wafer surface during a chemical mechanical polishing process when the process is temporarily halted due to tool alarm by spraying deionized water toward the wafer surface and removing slurry solution such that copper corrosion can be prevented It is yet another object of the present invention to provide a method for preventing copper corrosion on a wafer surface during a chemical mechanical polishing process by installing spray nozzles in the polishing apparatus and spraying a cleaning solvent onto the wafer surface for removing slurry solution during a temporary shut-down.

It is still another further object of the present invention to provide a polishing apparatus for polishing an electronic substrate on a polishing pad with a slurry solution to dispensed thereinbetween which includes at least one spray nozzle for dispensing a cleaning solvent toward the electronic substrate for removing slurry solution from the substrate during a temporary shut-down of the polishing apparatus.

It is yet another further object of the present invention to provide a chemical mechanical polishing apparatus for polishing a silicon wafer that has a copper layer deposited thereon which includes a cleaning apparatus for dispensing a cleaning solvent and removing slurry solution from the wafer surface during a temporary shut-down of the polishing apparatus to prevent corrosion of the copper layer.

SUMMARY OF THE INVENTION

In accordance with the present invention, a method for preventing metal corrosion on a wafer during a chemical mechanical polishing process when the process is temporarily halted due to tool alarm and an apparatus for carrying out such method are provided.

In a preferred embodiment, a method for preventing metal corrosion on a wafer during a chemical mechanical polishing process when the process is temporarily halted due to tool alarm can be carried out by the operating steps of providing a wafer that has a metal layer on a top surface to be polished by a polishing pad and by a slurry solution, the metal layer is susceptible to corrosion when exposed to the slurry solution in a stationary manner, mounting the wafer in a CMP apparatus with the metal layer on the wafer exposed, polishing the metal layer on the wafer by rotating against a polishing pad with a slurry solution dispensed thereinbetween, stopping the polishing process by the occurrence of a condition, and spraying a cleaning solvent toward the wafer surface and removing substantially all slurry solution from the wafer surface to prevent corrosion of the metal layer by the slurry solution.

The method for preventing metal corrosion on a wafer during a CMP process when the process is temporarily halted may further include the step of spraying a cleaning solvent of deionized water toward the wafer surface, or the step of spraying deionized water at a pressure between about 1 PSI and about 20 PSI toward the wafer surface. The method may further include the step of providing a plurality of spray nozzles for spraying the cleaning solvent, or the step of providing a plurality of spray nozzles mounted on bendable, shapable conduit for spraying the cleaning solvent. The method may further include the step of disengaging the wafer from the polishing pad such that the top surface of the wafer is exposed after the polishing process is stopped. The method may further include the step of providing the wafer with a copper layer on a top surface of the wafer.

The present invention is further directed to a polishing apparatus for polishing an electronic substrate on a polishing pad with a slurry solution dispensed thereinbetween, a substrate holder for holding an electronic substrate therein exposing an active surface of the substrate to be polished, the active surface of the substrate is at least partially covered by a metal layer, a polishing pad for rotating at a rotational speed of at least 10 RPM while engaging the active surface of the electronic substrate, a slurry solution for enhancing polishing of the active surface of the electronic substrate by the polishing pad, and at least one spray nozzle for dispensing a cleaning solvent towards the active surface of the electronic substrate when the substrate holder is disengaged and separated from the polishing pad during a temporary shut-down of the polishing apparatus for removing slurry solution from the active surface of the electronic substrate and preventing etching of the metal layer by the slurry solution.

The polishing apparatus of the present invention may be a chemical mechanical polishing machine. The at least one spray nozzle may further include a bendable, shapable conduit for mounting the spray nozzle and for transporting the cleaning solvent. The electronic substrate may be a silicon wafer, while the conductive layer on the electronic substrate may be a copper layer. The cleaning solvent dispensed toward the active surface of the electronic substrate may be deionized water. The active surface of the electronic substrate may further include a single-damascene interconnect structure formed of copper, or a dual-damascene interconnect structure formed of copper. The at least one spray nozzle may be mounted on a platform onto which the polishing pad is mounted at a position juxtaposed to the polishing pad.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a method for preventing metal corrosion, specifically copper corrosion on a wafer during a chemical mechanical polishing process when the process is temporarily halted due to equipment malfunction or other reasons. The invention further provides a polishing apparatus for polishing an electronic substrate on a polishing pad with a slurry solution dispensed thereinbetween which is equipped with a head rinse module capable of spraying a cleaning solvent onto the substrate surface for removing slurry solution during a temporary shut down of the polishing apparatus such that copper corrosion can be avoided.

In the method, a wafer is first provided that has a copper layer in a top surface to be polished by a polishing pad and by a slurry solution. The copper layer is susceptible to corrosion when exposed to the slurry solution in a stationary manner. The metal layer is then polished by rotating the wafer against a polishing pad with a slurry solution dispensed thereinbetween. When the polishing process is stopped by the occurrence of a specific condition, i.e., a tool alarm among a variety of conditions, a cleaning solvent is sprayed onto the wafer surface to remove substantially the slurry solution for preventing corrosion of the copper layer.

In the polishing apparatus, a substrate holder for holding an electronic substrate is first provided which is capable of holding a substrate therein while exposing an active surface of the substrate for polishing by a polishing pad. The apparatus further includes a polishing pad for rotating at a rotational speed while engaging the active surface of the substrate, and a slurry solution dispenser for dispensing slurry solution to enhance polishing of the active surface of the substrate when engaged to the polishing pad. The apparatus further includes at least one spray nozzle for dispensing a cleaning solvent toward the active surface of the electronic substrate when the substrate holder is disengaged and separated from the polishing pad during a temporary shut down of the polishing apparatus for removing slurry solution from the active surface of the electronic substrate and for preventing etching of the metal layer by the slurry solution.

Figure 1A:
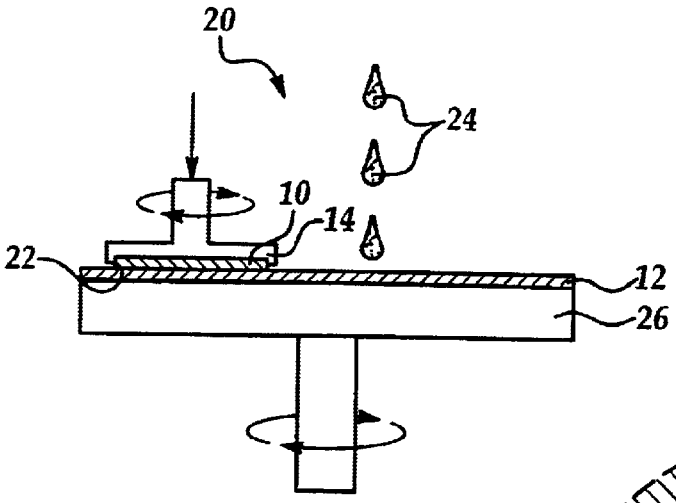
Figure 1A Prior Art
FIG. 1A is a schematic illustrating a typical chemical mechanical polishing apparatus.
Figure 1B:
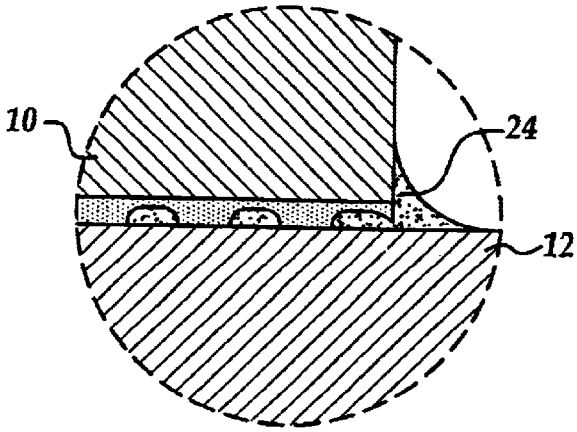
Figure 1B Prior Art
FIG. 1B is an enlarged, cross-sectional view of the wafer holder, the wafer and the polishing pad of FIG. 1A illustrating the interaction of slurry solution during a polishing process.
Figure 2A:
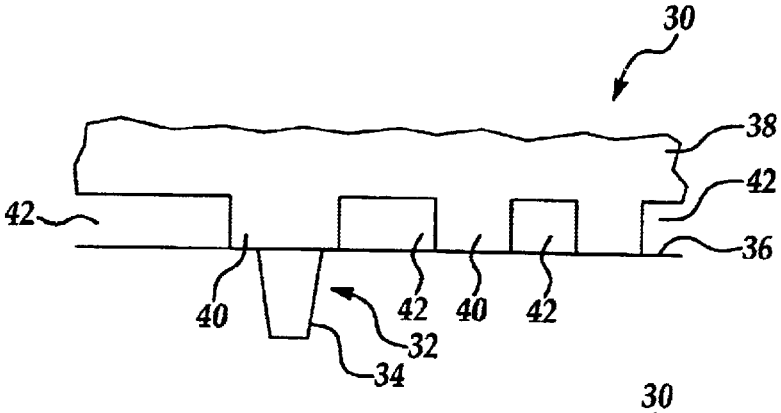
FIG. 2A is an enlarged, cross-sectional view showing an electronic substrate having a single-damascene interconnect structure built therein after copper layer is deposited into the damascene structure.

Referring now to FIG. 2A, wherein an enlarged, cross-sectional view of a present invention electronic substrate 30 that includes a single damascene interconnect structure 32 is shown. A via opening 34 is first filled with a conductive metal, such as tungsten, aluminum or copper. After the top surface 36 of the electronic substrate 30 is planarized, a copper layer 38 is deposited on top of the substrate 30 to fill trench openings 40 that are formed in an insulating material layer 42. The insulating material layer is most likely a silicon oxide layer deposited as an inter-layer dielectric (ILD) material. The copper layer 38 deposited into the trench opening 40 makes intimate contact with the via plug formed in the via opening 34.

In the next step of the process, the top surface 44 of the copper layer 38 is planarized to form trench 46 in electrical contact with the via plug formed in the via opening 34. The copper planarization process is conducted in a chemical mechanical polishing apparatus wherein the copper layer 38 or the top surface 44 of the copper trench 46 formed are subjected to corrosion by contact with the slurry solution during a chemical mechanical polishing process when the process is temporarily halted due to any equipment malfunction, as indicated by a tool alarm.

Figure 2B:
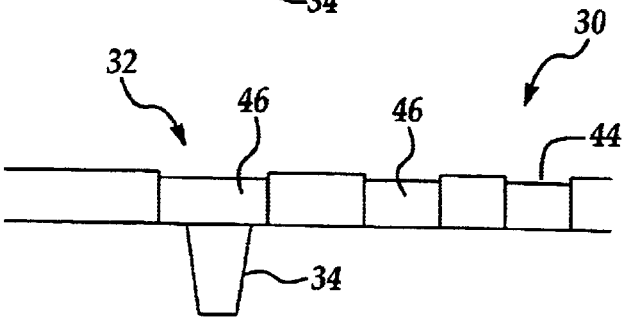
FIG. 2B is an enlarged, cross-sectional view of the electronic substrate of FIG. 2A after the single-damascene structure is polished in a chemical mechanical polishing apparatus.
Figure 3A:
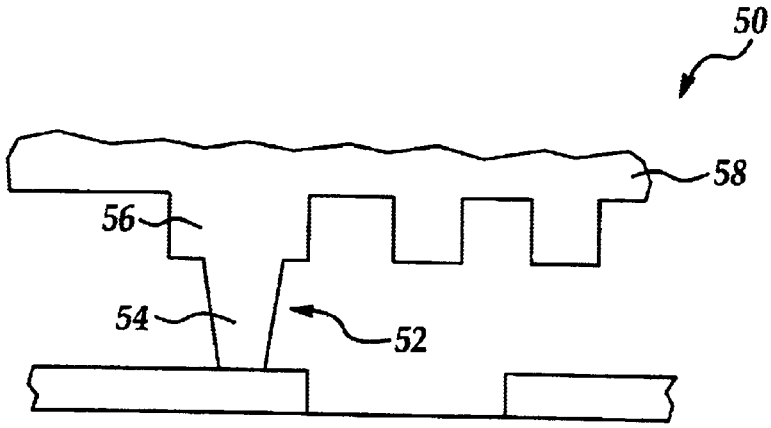
FIG. 3A is an enlarged, cross-sectional view of an electronic structure having a dual-damascene interconnect filled with a copper layer.
Figure 3B:
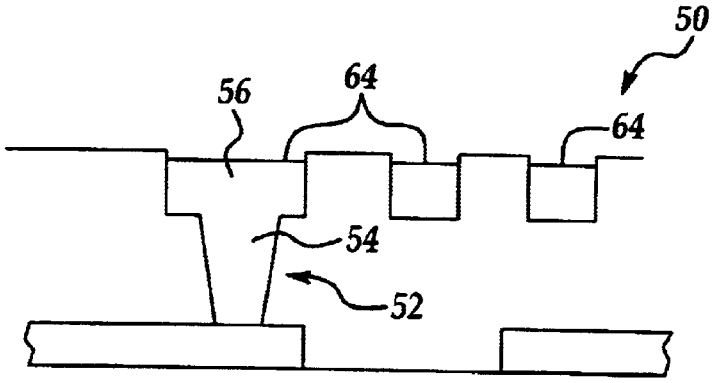
FIG. 3B is an enlarged, cross-sectional view of the electronic substrate of FIG. 3A after being polished in a chemical mechanical polishing apparatus.

Similarly, a dual-damascene structure 52 is formed in an electronic substrate 50, as shown in FIGS. 3A and 3B. The copper layer 58 is deposited to form a via 54 and a trench 56 simultaneously. After a top surface 64 is planarized in a chemical mechanical polishing process, the dual damascene interconnect structure 52 is completed. During the chemical mechanical polishing process, the fresh copper surface of either the copper layer 58 or the copper planarized top surface 64 can be subjected to attack by slurry solution forming CuO, $Cu_2O$ or Cu (OH). The oxidation process, i.e., corrosion process can be avoided by utilizing the present invention novel apparatus as shown in FIG. 4 such that the planner top surface 64 (shown in FIG. 3B) and the planner top surface 44 (shown in FIG. 2B) can be achieved.

Figure 4:
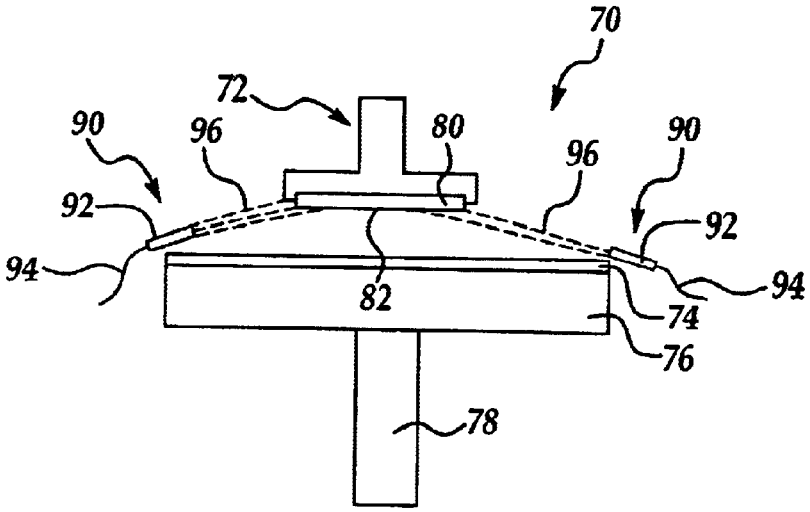
FIG. 4 is an illustration of the present invention chemical mechanical polishing apparatus equipped with spray nozzles for removing slurry solutions during a temporary process shut-down.

Referring now to FIG. 4, wherein an illustration in a cross-sectional view of the present invention chemical mechanical polishing apparatus 70 is shown. The apparatus 70 consists of a wafer holder 72 and a polishing table 76 for holding a polishing pad 74 thereon. The polishing table 76 is rotated by a support 78 during a polishing operation. It should be noted that, both the wafer holder 72 for holding a wafer 80 and the polishing table 76 are in a stationary mode, as shown in FIG. 4, during a temporary shut-down of the chemical mechanical polishing process.

The present invention head rinse model 90 is shown in FIG. 4 which consists of a plurality of spray nozzles 92 for spraying droplets 96 of a cleaning solvent toward an active surface 82 of the wafer 80. The spray nozzle 92 can be advantageously mounted on a flexible conduit 94 which is also used to transport the cleaning solvent therethrough. The flexible conduit 94 can be suitably made of a bendable, shapable conduit such as those formed by a metal tape. The head cleaning module 93B may be mounted on a platform that the polishing pad is mounted on and be positioned juxtaposed to the polishing pad without interfering with the rotation of the pad. The number of the plurality of head cleaning modules 90 required may be suitably selected, for instance, two or four head rinse modules 90 each equipped with a spray nozzle 92 may be adequate for spraying droplets of a cleaning solvent such as deionized water onto the wafer surface 82. When deionized water is utilized, a suitable pressure of the water may be between about 1 PSI and about 20 PSI, and preferably between about 1 PSI and about 10 PSI. The word "about" used in this writing indicates a range of values that is ±10% of the average value given. It should be noted that any suitable cleaning solvent may be used in the present invention head rinse module 90 other than deionized water as long as the solvent is efficient in removing substantially all the slurry solution from the wafer surface so that corrosion of the copper layer on top of the surface does not occur.

The present invention novel method for preventing copper corrosion on a wafer during a chemical mechanical polishing process and an apparatus for carrying out such method have therefore been amply described in the above description and in the appended drawings of FIGS. 2A~4.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows.

What is claimed is:

1. A method for preventing metal corrosion on a wafer during a chemical mechanical polishing (CMP) process when the process is temporarily halted comprising the steps of:

providing a wafer having a metal layer on a top surface to be polished by a polishing pad and a slurry solution, said metal layer being susceptible to corrosion when exposed to said slurry solution in a stationary manner, mounting said wafer in a CMP apparatus with said metal layer on said wafer exposed, polishing said metal layer on said wafer by rotating against a polishing pad with a slurry solution therein-between stopping said polishing process by the occurrence of a condition, and spraying a cleaning solvent toward said wafer surface and removing substantially all slurry solution from said wafer surface to prevent corrosion of said metal layer by the slurry solution.

2. A method for preventing metal corrosion on a wafer during a chemical mechanical polishing (CMP) process when the process is temporarily halted according to claim 1, wherein said step of spraying a cleaning solvent comprises spraying deionized water toward said wafer surface.

3. A method for preventing metal corrosion on a wafer during a chemical mechanical polishing (CMP) process when the process is temporarily halted according to claim 1, wherein said step of spraying a cleaning solvent comprises spraying deionized water at a pressure between about 1 psi and about 20 psi toward said wafer surface.

4. A method for preventing metal corrosion on a wafer during a chemical mechanical polishing (CMP) process when the process is temporarily halted according to claim 1 further comprising the step of providing a plurality of spray nozzles for spraying said cleaning solvent.

5. A method for preventing metal corrosion on a wafer during a chemical mechanical polishing (CMP) process when the process is temporarily halted according to claim 1 further comprising the step of providing a plurality of spray nozzles mounted on bendable, shapable conduit for spraying and cleaning solvent.

6. A method for preventing metal corrosion on a wafer during a chemical mechanical polishing (CMP) process when the process is temporarily halted according to claim 1 further comprising the step of disengaging said wafer from said polishing pad such that said top surface of the wafer is exposed after said polishing process is stopped.

7. A method for preventing metal corrosion on a wafer during a chemical mechanical polishing (CMP) process when the process is temporarily halted according to claim 1, wherein said metal layer on said top surface of the wafer is a copper layer.

* * * * *